US009631471B2

(12) United States Patent
Fordyce et al.

(10) Patent No.: US 9,631,471 B2
(45) Date of Patent: Apr. 25, 2017

(54) PROPPANT BLENDER

(71) Applicant: Step Energy Services Ltd., Calgary (CA)

(72) Inventors: Victor Fordyce, Red Deer (CA); Colin Peters, Okotoks (CA)

(73) Assignee: Step Energy Services LLC, Dover, DE (US)

( * ) Notice: Subject to any disclaimer, the term of this patent is extended or adjusted under 35 U.S.C. 154(b) by 84 days.

(21) Appl. No.: 14/103,622

(22) Filed: Dec. 11, 2013

(65) Prior Publication Data

US 2015/0157995 A1 Jun. 11, 2015

(51) Int. Cl.

| | |
|---|---|
| ***B01F 15/02*** | (2006.01) |
| ***E21B 43/267*** | (2006.01) |
| ***B01F 15/00*** | (2006.01) |
| ***B01F 5/16*** | (2006.01) |

(52) U.S. Cl.

CPC ..... *E21B 43/267* (2013.01); *B01F 5/16* (2013.01); *B01F 15/00857* (2013.01); *B01F 15/00993* (2013.01)

(58) Field of Classification Search

CPC ..... B08B 15/02; B01F 15/026; E21B 43/267; E21B 21/015; E21B 21/062; E21B 21/16

See application file for complete search history.

(56) References Cited

U.S. PATENT DOCUMENTS

| | | | | |
|---|---|---|---|---|
| 4,137,904 | A | 2/1979 | Dorius | |
| 5,509,851 | A | 4/1996 | Heuschkel | |
| 6,502,633 | B2 | 1/2003 | Cooper | |
| 7,963,282 | B2 | 6/2011 | Griffin | |
| 7,975,851 | B2 | 7/2011 | Kossowan | |
| 2007/0204991 | A1* | 9/2007 | Loree et al. | 166/280.1 |
| 2013/0309052 | A1* | 11/2013 | Luharuka et al. | 414/291 |
| 2015/0107822 | A1* | 4/2015 | Tudor | 166/90.1 |

* cited by examiner

*Primary Examiner* — Tony G Soohoo
*Assistant Examiner* — Elizabeth Insler
(74) *Attorney, Agent, or Firm* — Christensen O'Connor Johnson Kindness PLLC

(57) ABSTRACT

A vapor hood for a proppant blending system, with a proppant entrance port to receive proppant, the proppant entrance port having a one way valve to allow the flow of proppant but prevent the backflow of vapor when the proppant is not entering the vapor hood.

18 Claims, 10 Drawing Sheets

PROPPANT BLENDER

TECHNICAL FIELD

Addition of proppant into a fluid.

BACKGROUND

Use of a hydrocarbon fluid over 2 psi Reid vapor pressure (RVP) is restricted for use in hydraulic fracturing without written permission from regulators. Also, if the flash point is 0 C or less it is a special consideration fluid. Both RVP and Flash point drive the classification of high Reid vapor pressure (HRVP) fluids. A conventional open tub blender could not be used with HRVP hydrocarbons. Accordingly, there is a means of enclosing a blender tub to enable HRVP fluids to be used.

U.S. Patent Application No. 2007/0204991 discloses a proppant mixing system that relies on a spinning impeller mixing frac fluid with proppant to generate a dynamic seal. A continuous flow of proppant is allowed through a check valve and control valve. However, the tub is not adequately enclosed, particularly between the tub and the auger.

SUMMARY

Accordingly, there is disclosed a vapor capturing system to enable HRVP fluids to be used in hydrocarbon fracturing operations. In an embodiment, there is disclosed a vapor hood for attachment to a blender tub for mixing proppant with a hydrocarbon fluid, the blender tub having an opening for receiving proppant, the vapor hood comprising a vapor-containing chamber adapted to be secured around the opening of the blender tub, a proppant entrance port to the vapor-containing chamber for receiving proppant from a proppant supply source, and a vapor extraction port for extracting vapor from the vapor-containing chamber.

In various embodiments, there may be included any one or more of the following features: the proppant entrance port may comprise a one-way valve for preventing the escape of vapor through the proppant entrance port when proppant is not entering the vapor-containing chamber through the proppant entrance port. The vapor extraction port may be connected to a flare system. The vapor extraction port may be connected to a vapor recovery system. The one way valve may comprise a damper system to allow a flow of proppant to complete before the one way valve closes. The vapor hood may further comprise a sensor to detect when proppant is entering the proppant entrance port. The vapor hood may further comprise a viewport in the vapor-containing chamber to allow a person outside the vapor-containing chamber to view the proppant entrance port from a direction interior to the vapor-containing chamber.

In an embodiment, there is disclosed an apparatus for mixing proppant with a hydrocarbon fluid, comprising a blender tub for combining the hydrocarbon fluid and proppant, the blender tub having an opening for receiving proppant, a vapor-containing chamber secured around the opening of the blender tub, a proppant entrance port to the vapor-containing chamber for receiving proppant from a proppant supply source; and a vapor extraction port for extracting vapor from the vapor-containing chamber.

In various embodiments, there may be included any one or more of the following features: the proppant entrance port comprises a one-way valve for preventing the escape of vapor through the proppant entrance port when proppant is not entering the vapor-containing chamber through the proppant entrance port; the vapor extraction port is connected to a flare system; the vapor extraction port is connected to a vapor recovery system; the one way valve comprises a damper system to allow a flow of proppant to complete before the one way valve closes; a sensor to detect when proppant is entering the proppant entrance port; and a viewport in the vapor-containing chamber to allow a person outside the vapor-containing chamber to view the proppant entrance port from a direction interior to the vapor-containing chamber.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

A proppant blender receives proppant, for example sand, from a proppant delivery system, for example, augers. The proppant blender comprises a vapor hood or vapor containing chamber connected to a tub for blending fluid with proppant. A sensor system may be used to detect when sand is entering the proppant blender for use with an automated system to control the flow rate of proppant and hydrocarbon fluid into the blender tub. In the embodiment shown, viewport windows are used to determine when sand is entering. The sand is delivered through a proppant entrance port having a one way valve that closes to prevent the escape of vapor when sand is not entering. The one way valve may include a damping element to cause the valve to close slowly enough to allow the flow of sand to complete before the valve closes. In the embodiment shown, the sand is delivered to the vapor hood component of the blender. Alternatively, the sand could be delivered directly to the tub component. A motor is used to drive a mixing element in the tub. The mixing element may comprise, for example, a centrifugal pump. In the embodiment shown, the motor is mounted above the vapor hood and drives the mixing element via a shaft that extends through a sleeve of the vapor hood. In other embodiments, the motor may be positioned differently. The vapor hood may have a pressure relief valve to protect from overpressure during an upset. A vapor collection valve connected to the blender may receive vapors for redirection to a flare system or into a gas recapture system.

Figure 1:
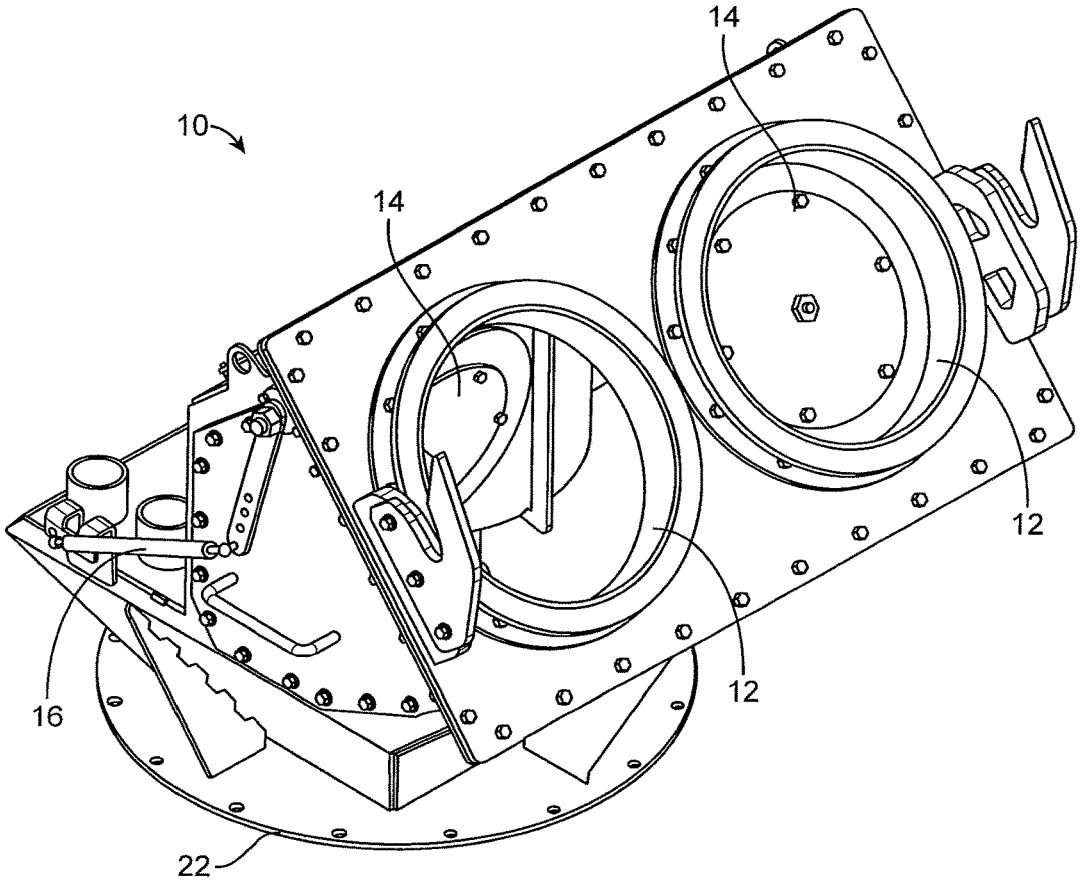
FIG. 1 is a front right perspective view of a vapor hood for a proppant blender.
Figure 2:
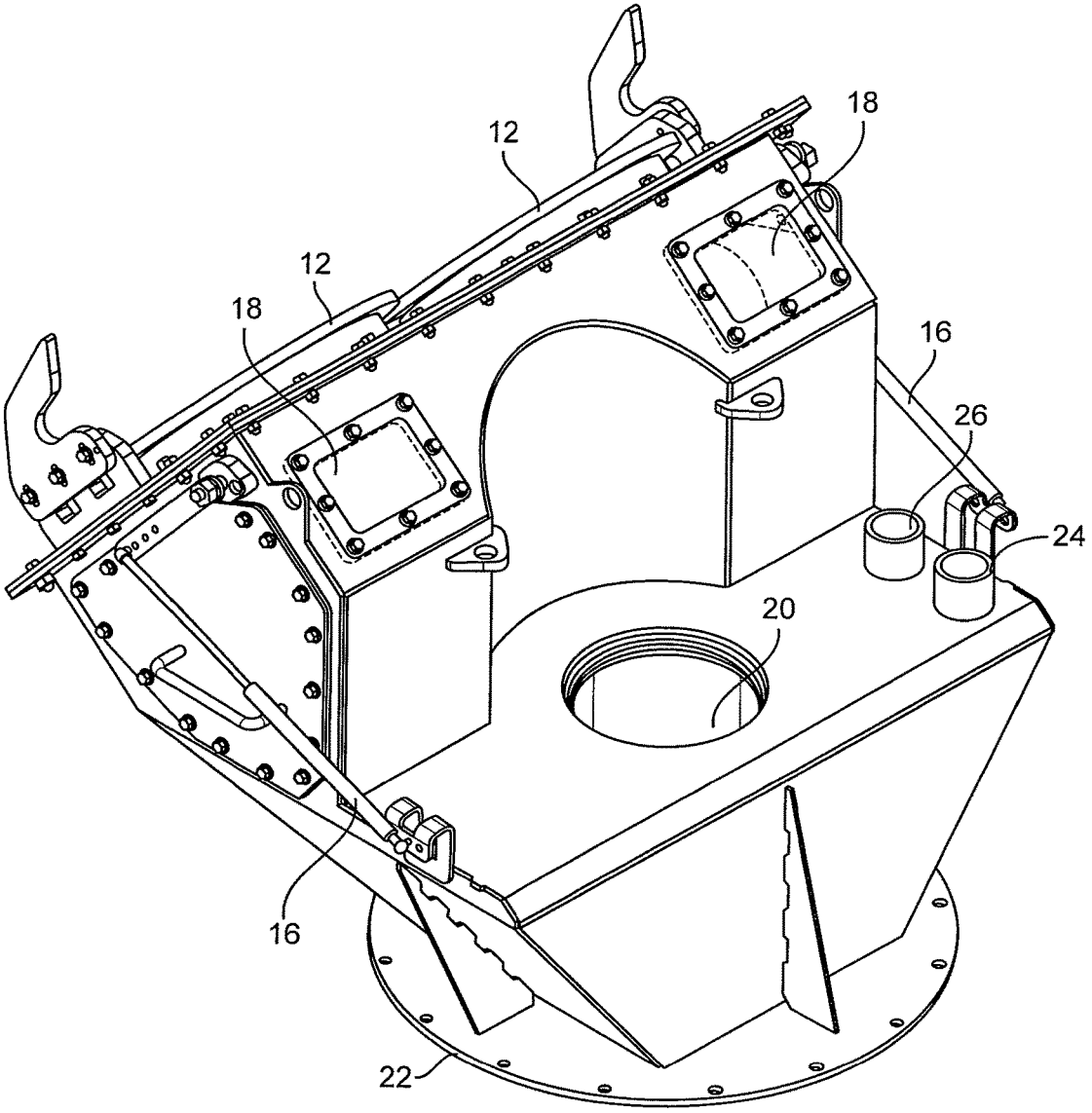
FIG. 2 is a rear perspective view of the vapor hood of FIG. 1.
Figure 3:
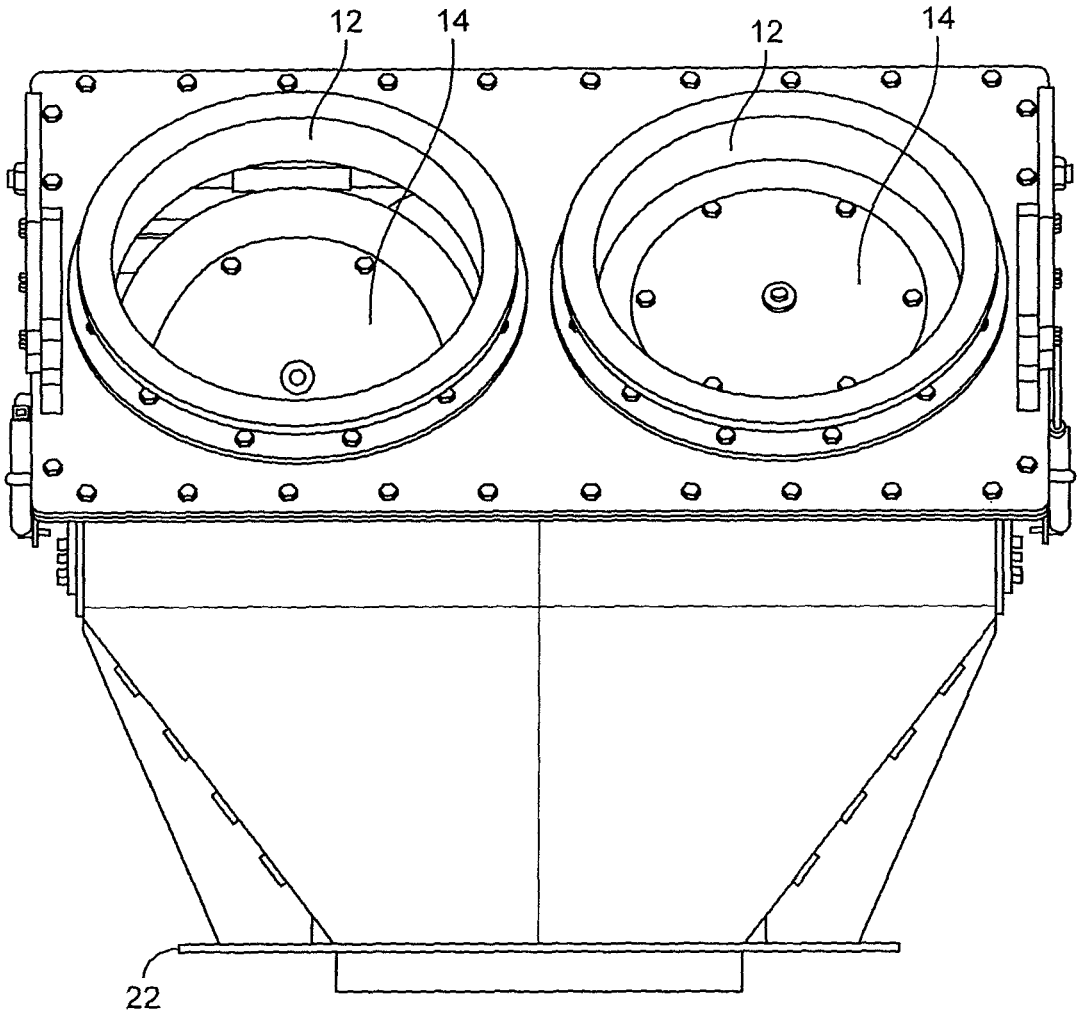
FIG. 3 is a front view of the vapor hood of FIG. 1.
Figure 4:
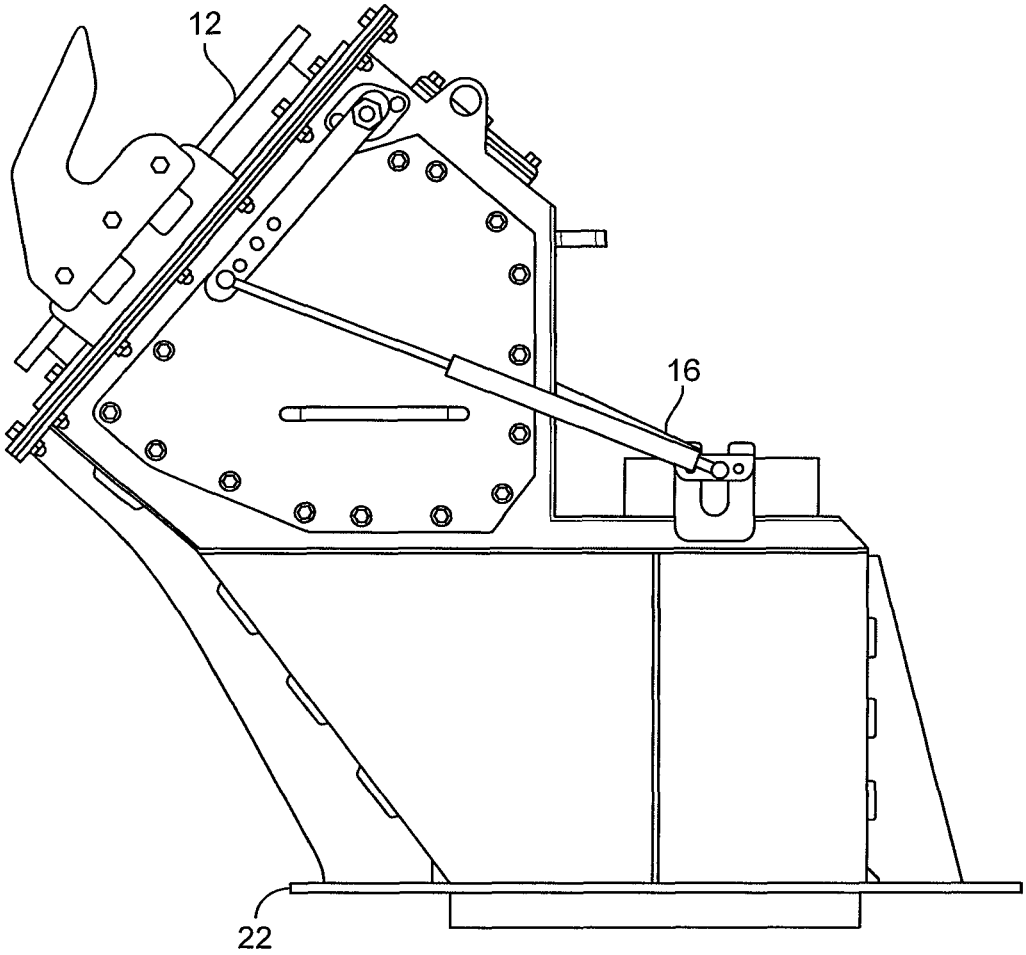
FIG. 4 is a side view of the vapor hood of FIG. 1.
Figure 5:
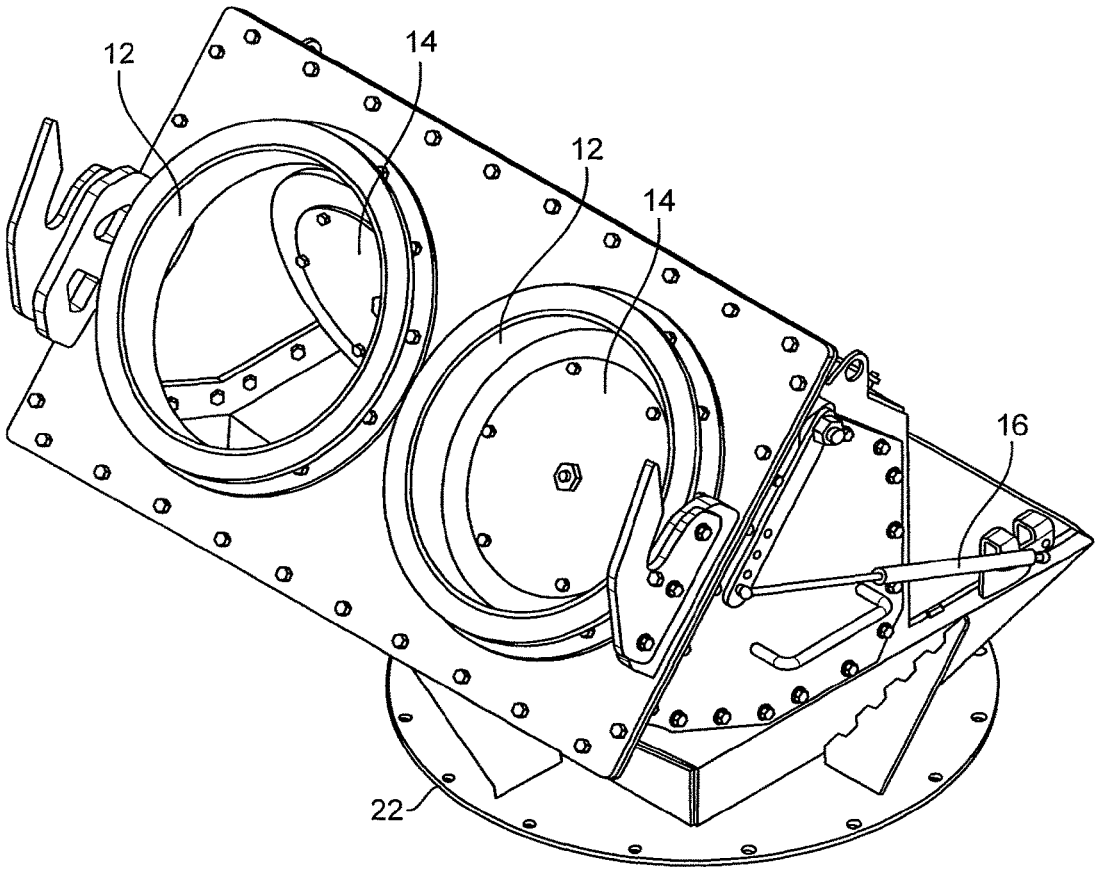
FIG. 5 is a front left perspective view of the vapor hood of FIG. 1.

Referring to FIGS. 1-5, a vapor hood 10 for a proppant blender is shown. In FIGS. 1 and 5, proppant entrance ports 12 are shown with one way valves 14 to prevent the escape of vapor when sand is not entering. Dampers 16 are connected to the one way valves to allow a flow of sand (proppant) to complete before the valves close. The dampers 16 retard the closing rate of the one way valves 14 and may comprise air springs. FIG. 2 shows viewports 18 for viewing the one way valves and the flow of sand through the one way valves. Sleeve 20 allows a drive shaft to pass through the vapor hood without providing a path for the escape of vapor. Fittings 24 and 26 may be a vent and pressure relief valve. Flange 22 allows the attachment of the vapor hood to a blender tub, from which the vapor hood captures vapors. FIG. 3 and FIG. 4 provide front and side views respectively of the vapor hood. The dimensions marked are in inches and should not be taken to be limiting in any way.

Figure 6:
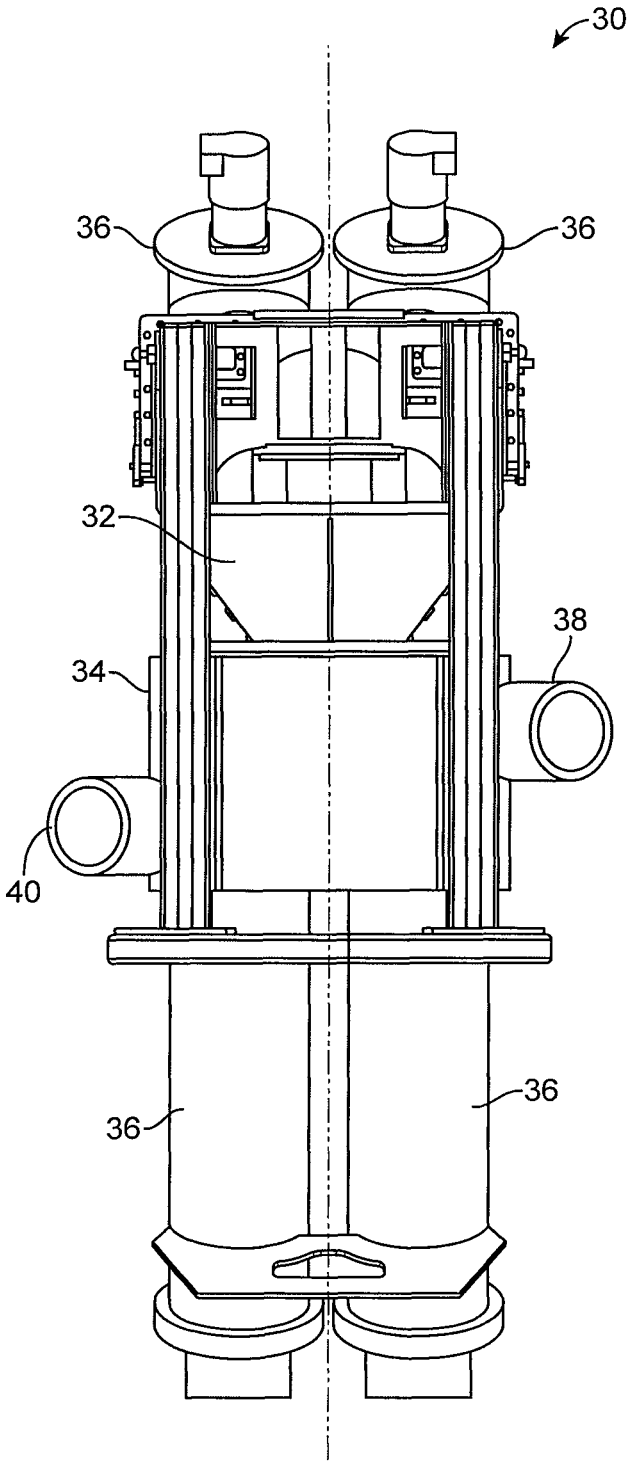
FIG. 6 is a rear view of a proppant blending system including a vapor hood, with a section line marked.
Figure 6A:
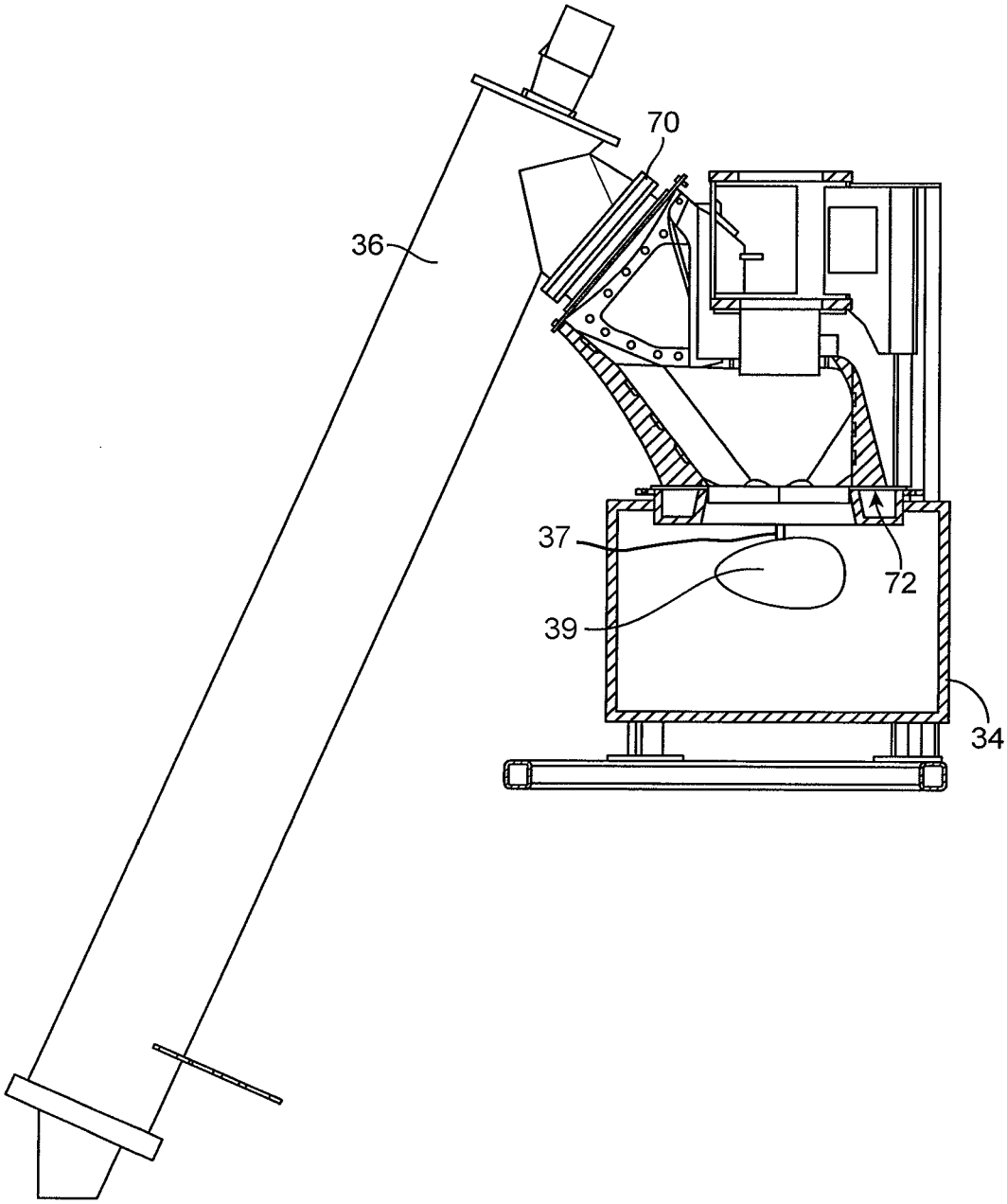
FIG. 6A is a side section from the view of FIG. 6.

Referring to FIG. 6, a proppant blender system 30 comprises vapor hood 32 and blender tub 34. The proppant blender system 30 receives proppant from augers 36. Pipe 38 delivers a fluid to the blender tub and pipe 40 takes fluid blended with proppant from the blender tub. FIG. 6*a* shows a section view of the proppant blender system. The proppant entrance ports seal to the auger using an air bag face seal 70. As shown in FIG. 6A, gasket seal 72 seals the vapor hood around an opening at the top of the blender tub.

Figure 7:
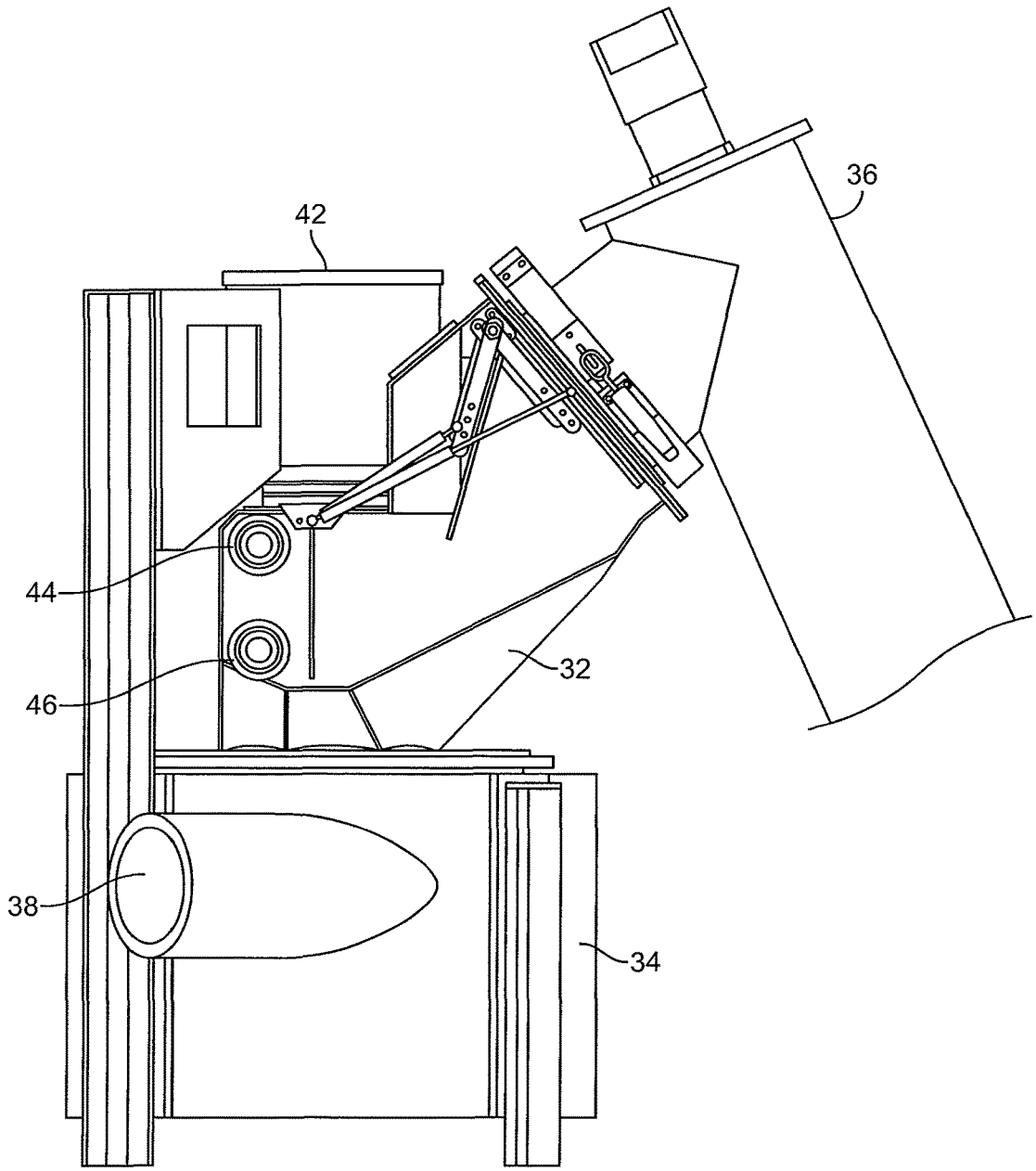
FIG. 7 is a side view of the proppant blending system of FIG. 6.
Figure 8:
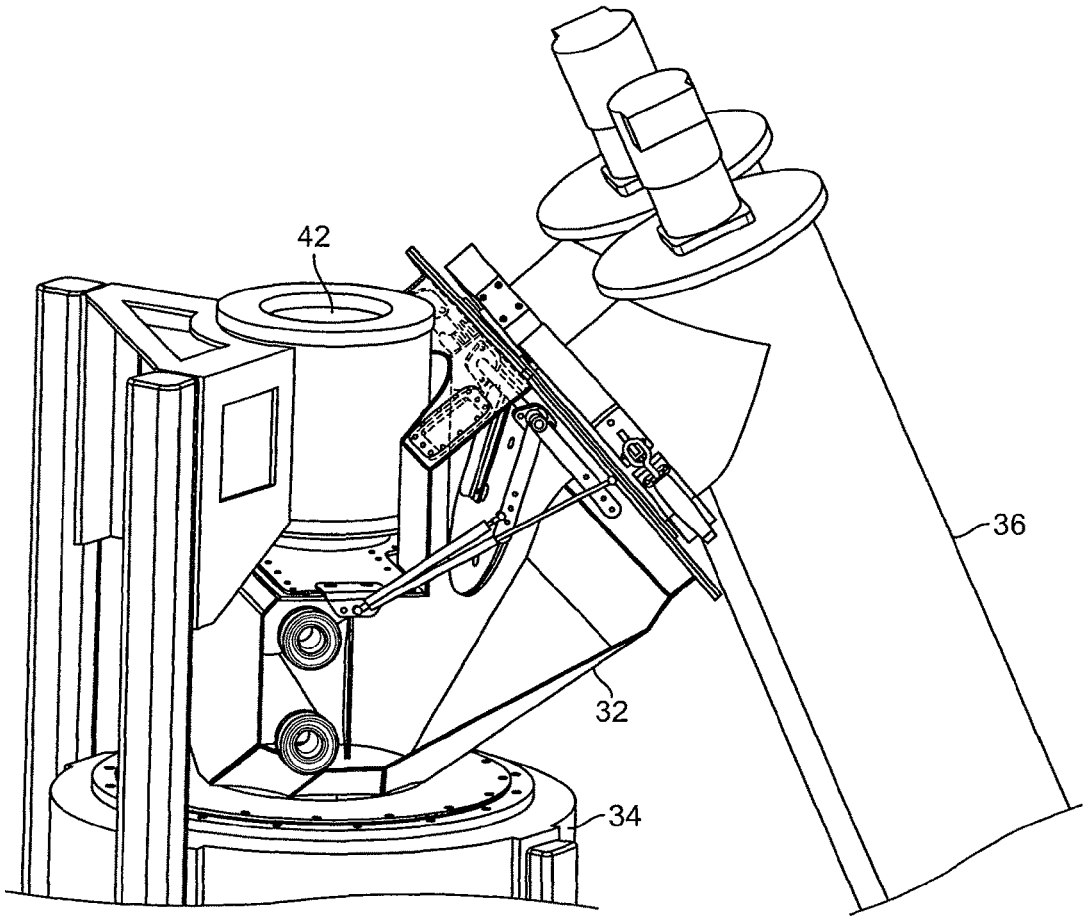
FIG. 8 is a side perspective view of the proppant blending system of FIG. 6.

FIG. 7 shows a side view of the proppant blender system. Fittings 44 and 46 may be a vent and a pressure relief valve and function as part of a vapor extraction system that includes the fittings 44 and 46 functioning as ports, lines connected to the ports and vapor recovery or disposal equipment. Vapor recovery equipment may comprise tanks holding the hydrocarbon fluid. Vapor disposal equipment may comprise a flare stack. The fittings 44 and 46 may be placed on any suitable location on the blender tub 34 for example on an upward facing surface as in FIG. 2 or a side facing surface as in FIG. 7. Additional fittings may be provided for supplying $N_2$ to purge the system or for measuring the pressure inside the hood. The vent may have a manually operated valve and the pressure relief valve may have a valve that opens automatically at a set pressure. FIG. 8 shows a perspective view of the vapor hood in the proppant blender system. Motor 42 drives a mixing element 39 (not shown in FIG. 8, but see FIG. 6A) in blender tub 34. An air bag shaft seal is fitted within sleeve 20 containing a shaft 37 connecting motor 42 to the mixing element 39.

Figure 9:
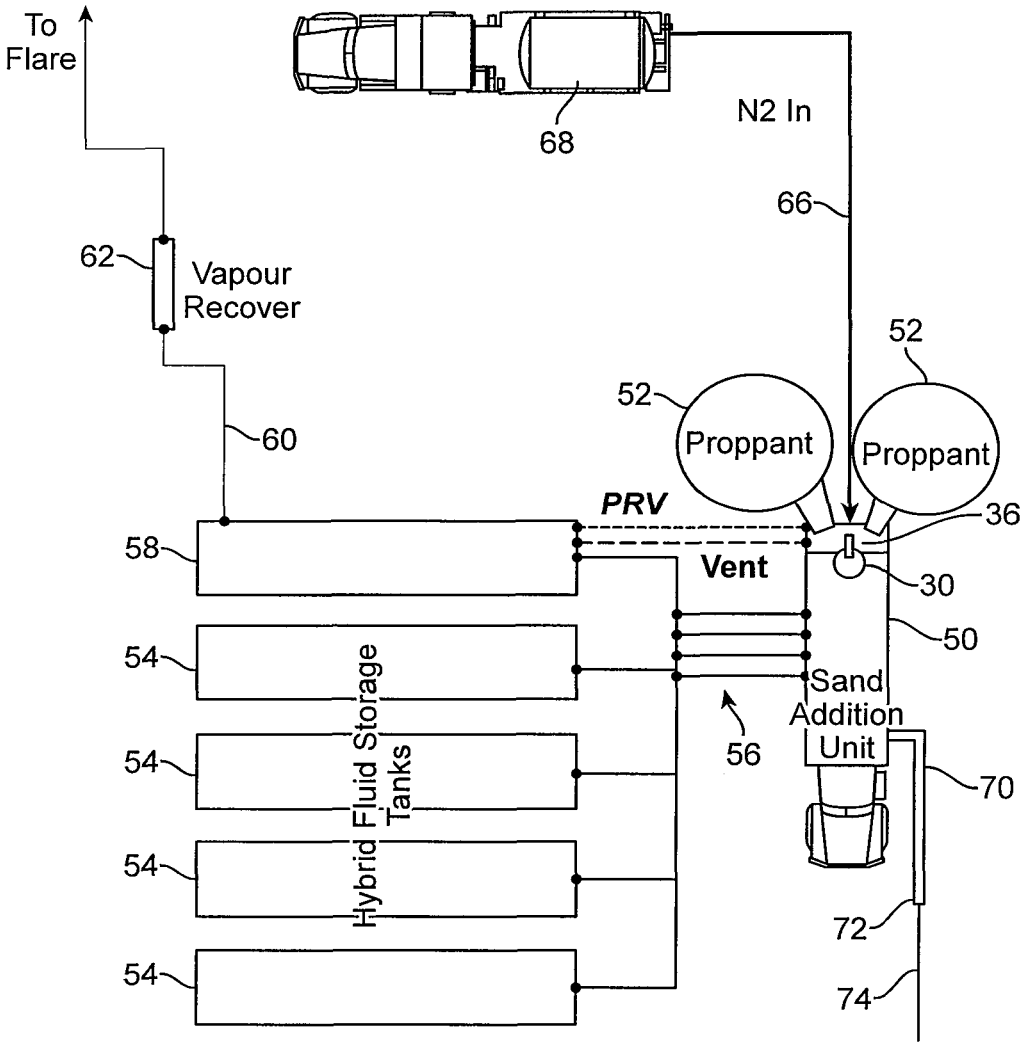
FIG. 9 is a schematic diagram of a proppant and fluid handling system including the proppant blending system of FIG. 6.

FIG. 9 is a schematic diagram of a proppant and fluid handling system including the proppant blending system of FIG. 6. In the embodiment shown, the proppant blender system 30 is mounted on a truck 50. The proppant blender system receives sand from augers 36 that lift the sand from a hopper (not shown) fed by two proppant containers 52. Fluid storage tanks 54 store fluid which is delivered to the proppant blending system along lines 56 for mixing with proppant. At least one fluid storage tank 58 is configured to receive vapor from the proppant blending system, and in this embodiment is connected via line 60 with a vapor recovery system 62 and flare (not shown). Nitrogen is delivered to the proppant blending system via line 66 from nitrogen source 68. The nitrogen is used to purge system components and may also be added to the frac mix when fracking coal gas or shale gas formation.

The embodiments shown are designed to capture the vapors from an open tub while adding a proppant into the flow. They will allow for use with high Reid Vapor pressure hydrocarbons. The vapor hoods shown connect the top of the blender tub to the discharge of the metering augers and provides a pressure seal capable of withstanding the pressure differential between the fluid and the ambient air. The embodiments shown are designed to work at less than 1 Atmosphere overpressure. In an example embodiment, the pressure differential between the interior of the vapor hood and the outside air may be equal to the vapor pressure of the fluid. In some embodiments, the system may be adapted for existing equipment (i.e. to fit onto a conventional open tub blender) with minimal alterations.

Vapor pressures above 2 PSI at 37 C-125 F are considered High Hazard and cannot be used with open top systems, without ensuring the atmosphere is safe for the equipment and personnel in the area. The proposed vapor hood may be designed for use with >2 PSI and <11 PSI. For reference, gasoline is 10 PSI at 120 F. The fluid used may be a hybrid fluid, or combination of commercially available fluids, that comprises, for example, C7-C18 hydrocarbons and is mixed at the well head with LPG. All of the hybrid fluid for sand addition may be over 2 PSI. Proppant loaded fluid from the blender disclosed may be supplied directly to a well head for mixing with LPG from high pressure pumps. Alternatively, proppant loaded fluid from the blender disclosed may be combined with a flow of hydrocarbon fluid from a separate high pressure pump before or at the wellhead. In an embodiment, as shown in FIG. 9, a first line 70 receives fluid blended with proppant from the proppant blender, and a second line 72 receives fluid from a separate pump (not shown) on the truck 50 (or could be on another truck). These lines merge into a common line 74 which goes to the well head. Thus, a lower vapor pressure fluid could be used for the proppant blender and a higher vapor pressure fluid may be separately pumped and combined with the proppant loaded lower vapor pressure fluid to provide a fluid tailored to the specific formation to be fractured.

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A vapor hood for attachment to a blender tub for mixing proppant with a hydrocarbon fluid, the blender tub having an opening for receiving proppant, the vapor hood comprising:

a vapor-containing chamber adapted to be secured around the opening of the blender tub;

a first pressure-tight seal on an end of the vapor-containing chamber for sealing the vapor-containing chamber onto the blender tub;

a proppant entrance port to the vapor-containing chamber for receiving proppant from a proppant supply source;

the proppant entrance port including a one-way valve for preventing the escape of vapor through the proppant entrance port when proppant is not entering the vapor-containing chamber through the proppant entrance port;

a second pressure-tight seal on the proppant entrance port for sealing with the proppant supply source;

a sleeve opening on the vapor-containing chamber for accommodating a motor shaft, the sleeve opening further comprising a shaft seal; and a vapor extraction port for extracting vapor from the vapor-containing chamber, wherein the vapor-containing chamber, the first pressure-tight seal and the shaft seal are configured to maintain a pressure differential between an interior of the vapor-containing chamber and an exterior of the vapor-containing chamber.

2. The vapor hood of claim 1 in which the vapor extraction port is connected to a flare system.

3. The vapor hood of claim 1 in which the vapor extraction port is connected to a vapor recovery system.

4. The vapor hood of claim 1 in which the one-way valve comprises a damper system to allow a flow of proppant to complete before the one-way valve closes.

5. The vapor hood of claim 1 further comprising a viewport in the vapor-containing chamber to allow a person outside the vapor-containing chamber to view the proppant entrance port from a direction interior to the vapor-containing chamber.

6. Apparatus for mixing proppant with a hydrocarbon fluid, comprising:

a blender tub for combining the hydrocarbon fluid and proppant, the blender tub having an opening for receiving proppant;

a vapor-containing chamber secured around the opening of the blender tub;

a proppant entrance port to the vapor-containing chamber for receiving proppant from a proppant supply source;

the proppant entrance port including a one-way valve for preventing the escape of vapor through the proppant entrance port when proppant is not entering the vapor-containing chamber through the proppant entrance port;

a motor installed above the vapor-containing chamber;

a drive shaft extending from the motor into the vapor-containing chamber to drive a mixer inside the blender tub;

a sleeve opening through the vapor-containing chamber for accommodating the drive shaft;

a seal between the drive shaft and the sleeve opening; and a vapor extraction port for extracting vapor from the vapor-containing chamber, the vapor-containing chamber configured to maintain a pressure differential between an exterior of the vapor-containing chamber and an interior within the vapor-containing chamber and the blender tub.

7. The apparatus of claim 6 in which the vapor extraction port is connected to a flare system.

8. The apparatus of claim 6 in which the vapor extraction port is connected to a vapor recovery system.

9. The apparatus of claim 6 in which the one-way valve comprises a damper system to allow a flow of proppant to complete before the one-way valve closes.

10. The apparatus of claim 6 further comprising a viewport in the vapor-containing chamber to allow a person outside the vapor-containing chamber to view the proppant entrance port from a direction interior to the vapor-containing chamber.

11. The vapor hood of claim 1 wherein the first pressure-tight seal is a gasket seal, the second pressure-tight seal is an air bag face seal and the shaft seal is an air bag shaft seal.

12. The vapor hood of claim 1 wherein the first pressure-tight seal is configured to hold a pressure differential of >2 PSI and <11 PSI.

13. The vapor hood of claim 1 wherein the end of the vapor-containing chamber is a lower end of the chamber, and the sleeve opening is positioned on an upper end of the vapor-containing chamber opposite the lower end.

14. The apparatus of claim 6 wherein the pressure differential is an overpressure within the interior.

15. The apparatus of claim 14 wherein the pressure differential is >2 PSI and <11 PSI.

16. The apparatus of claim 6 further comprising a pressure-tight seal on a lower end of the vapor-containing chamber for sealing the vapor-containing chamber onto the blender tub.

17. The apparatus of claim 16 further comprising a second pressure-tight seal on the proppant entrance port for sealing with the proppant supply source.

18. The apparatus of claim 17 wherein the pressure-tight seal is a gasket seal, the second pressure-tight seal is an air bag face seal and the seal is an air bag shaft seal and the seal between the drive shaft and the sleeve is an air bag shaft seal.

* * * * *